US005696344A

United States Patent [19]

Fujimoto

[11] Patent Number: 5,696,344

[45] Date of Patent: Dec. 9, 1997

[54] ELECTRONIC KEYBOARD INSTRUMENT FOR PLAYING MUSIC FROM STORED MELODY AND ACCOMPANIMENT TONE DATA

[75] Inventor: Satoshi Fujimoto, Shizuoka-ken, Japan

[73] Assignee: Kabushiki Kaisha Kawai Gakki Seisakusho, Japan

[21] Appl. No.: 579,217

[22] Filed: Dec. 28, 1995

[30] Foreign Application Priority Data

Feb. 24, 1995 [JP] Japan ..... 7-060093

[51] Int. Cl.[6] ..... A63H 5/00; G04B 15/00; G10H 7/00

[52] U.S. Cl. ..... 84/609; 84/634

[58] Field of Search ..... 84/609, 610, 634

[56] References Cited

U.S. PATENT DOCUMENTS 4,594,931 6/1986 Ishii ..... 84/609
5,085,117 2/1992 Morokuma et al. .
5,262,584 11/1993 Shimada ..... 84/609
5,276,274 1/1994 Morokuma et al. .
5,457,282 10/1995 Miyamoto et al. ..... 84/634

*Primary Examiner*—William M. Shoop, Jr.
*Assistant Examiner*—Jeffrey W. Donels
*Attorney, Agent, or Firm*—Andrus, Sceales, Starke & Sawall

[57] ABSTRACT

An electronic keyboard instrument which functions to afford an unskilled player the sensation of being a skilled player has a plurality of data storage areas for defining pattern data that correspond to a plurality of tone ranges into which a tone range on a keyboard is divided, and for independently storing the pattern data so defined. A plurality of data readers read corresponding pattern data from the data storage areas, wherein, when keys that belong to the tone ranges are depressed, the pattern data that correspond to the tone ranges are read one at a time from whichever of the data storage areas is pertinent.

7 Claims, 11 Drawing Sheets

ELECTRONIC KEYBOARD INSTRUMENT FOR PLAYING MUSIC FROM STORED MELODY AND ACCOMPANIMENT TONE DATA

BACKGROUND OF THE INVENTION

1. Field of the Invention

The present invention is related to an electronic keyboard instrument that has an "instant pleasure" function in which music is played from stored melody and accompaniment tone data, and in particular to an electronic keyboard instrument wherein different pattern data are assigned to tone ranges on a keyboard, and wherein a data pattern that is assigned to a tone range corresponding to a manipulated key is generated to play music.

2. Related Arts

Conventionally, an instant pleasure function is known as a function whereby a person who is not skilled in playing an electronic keyboard instrument is afforded the sensation of being a skilled player simply by depressing keys on a keyboard without being concerned about which positions on a keyboard control which pitches.

For an electronic keyboard instrument that has the instant pleasure function (hereafter referred to as an "IP function"), keys on a single keyboard are depressed at a specific rhythm, with disregard for the pitch positions, and the musical piece is played that has been selected from among a number of musical pieces that are stored as data.

The basic pattern of the IP function will be described by employing musical piece "Aka-tombo" (Red dragonfly) while referring to FIG. 11. The rhythm for the melody of "Aka-tombo" contains quarter notes and eighth notes.

In FIG. 11B is the melody as it is represented by IP data that is played at a constant rhythm. The notation wherein eighth notes are the smallest is provided for "Aka-tombo." Therefore, a player plays music by using the notation for which the smallest note in the musical piece is employed, e.g., at a rhythm for eighth notes.

At this time, for the IP data for a sustained tone, such as tone A, the "ya" that is specified by (note 1) in FIG. 11B, such information is stored that a preceding tone (tone A) is prolonged when the key for a second tone, B, that falls within the range indicated by (note 1) is depressed; and that a tone that is currently being generated is halted when the key for a third tone, C, is depressed.

When a sustained tone, such as tone A, is to be generated, control information is transmitted to a tone signal generator in advance, so that the halting of the production of a tones upon each depression of a key is avoided and playing can be smoothly performed.

As another method, there is an IP function that plays music at the rhythm for a melody, i.e., a function whereby a player is required to depress and hold keys in consonance with the rhythm of a melody and thus control the tone-on duration of musical tones as the keys are depressed and released.

According to this function, when the musical piece "Aka-tombo" is selected and a single key is depressed four times, for "yu," "u," "ya," and "ke," in agreement with the rhythm of the melody, as a consequence of these manipulations, the sounds "yuu-yaa-ke ko-ya-ke" of the melody and the sounds of the accompaniment are generated from stored music data for "Aka-tombo," and playing begins.

FIG. 10 is a schematic block diagram illustrating an electronic keyboard instrument that has such a conventional instant pleasure function which functions to provide an unskilled person the sensation of actually playing the instrument. As is shown in FIG. 10, when a depressed key detector 2 detects that a key has been depressed, melody tone data and accompaniment tone data are read from a storage area 23 for IP data by an IP data reader 22, and are released through a loudspeaker 9.

Melody tone data and accompaniment tone data are stored together in the IP data storage area 23.

When a player depresses a single key at a constant rhythm, the melody tone data and the accompaniment tone data that are stored in advance in the IP data storage area 23 are read together in consonance with the key manipulation, and the tones are generated.

Therefore, even beginners who are not familiar with an electronic keyboard instrument, or children, feel as though they were playing music and enjoy playing the instrument. However, since with this IP function only a single finger is required for playing, the operations very simple, and as a player becomes more familiar with the function, his interest flags and he becomes bored.

SUMMARY OF THE INVENTION

To overcome the above shortcoming, it is one object of the present invention to provide an electronic keyboard instrument that can store pattern data independently that correspond to tone ranges, which are a high tone range, a low tone range, etc., on a keyboard to which depressed keys belong, and that can generate tones with different patterns in order, one at a time, in consonance with the tone ranges of the depressed keys.

To achieve the above object, an electronic keyboard instrument, which has an instant pleasure function, comprises: a plurality of instant pleasure data (hereafter referred to as "IP data") storage areas for defining pattern data that correspond to a plurality of tone ranges into which a tone range on a keyboard is divided, and for storing the pattern data that are defined independently; and a plurality of IP data readers for reading corresponding pattern data from the IP data storage areas, wherein, when keys that belong to the tone ranges are depressed, the pattern data that correspond to the tone ranges are read one at a time from whichever of the IP data storage areas is pertinent.

According to the present invention, the pattern data are divided into sets for every measure block or for every tone block, and are correlated with each other when stored in the IP data storage areas, and an electronic keyboard instrument further comprises: key count units for counting the pattern data, which are read from the IP data storage areas, for each measure block or for each tone block of the pattern data for each of the tone ranges; and a decision unit for detecting a change of the measure block or of the tone block when the measure block or the tone block at a reference pattern data read position is to be changed, for finding a reading position for succeeding data in another pattern data, and for adjusting the position when the reference pattern data reading position and the reading position for the succeeding data are shifted.

The present invention further comprises an instruction switch for instructing the reading of the reference pattern data.

The present invention further comprises a head read switch for selecting and reading an arbitrary measure block or a tone block from each of the pattern data sets that are stored in the IP data storage areas, wherein the decision unit permits reading a predetermined measure block or tone block in consonance with a set value that is selected by the head read switch.

According to the present invention, the pattern data for a plurality of musical pieces are stored in the IP data storage areas, a desired musical piece is selected by using a music select switch, and an interrupt unit determines a tone generation start position for pattern data for the desired musical piece.

In addition, according to the present invention, the tone range of the keyboard is divided into a high tone range and a low tone range.

According to the present invention, the pattern data are melody tone data and accompaniment tone data.

According to an electronic keyboard instrument of the present invention, the tone range of the keyboard is divided into, for example, a high tone range and a low tone range, and different pattern data, such as data for melody tones and accompaniment tones, that correspond to the tone ranges, are stored in the IP data areas. In consonance with a tone range to which a depressed key on a keyboard belongs, corresponding pattern data are read and tone production is performed.

For tone generation of, for example, melody tones in the high tone range, each tone is produced by key depression and release and at the rhythm for a melody, as is shown in FIG. 11A.

On the other hand, automatic accompaniment tones in the low tone range are constantly produced, one after the other, at equal intervals, as is shown in FIG. 11B.

An IP data reader that reads IP data for each tone range is provided, and IP data that consist of, for example, melody tone data and accompaniment tone data are stored for each tone range in the IP data storage areas.

A depressed key detector determines the tone range to which a key belongs whose manipulation has been detected. According to the detection result, stored pattern data for the tone range that corresponds to the depressed key are read in order from the IP data storage unit and tone production with the data is performed.

In this manner, accompaniment tones are produced by the manipulation of keys in the low tone range and melody tones are generated by the manipulation of keys in the high tone range. Playing with both hands can be accomplished by depressing two keys, are in the low and one in the high tone range, on a keyboard, and an electronic keyboard instrument can be provided that is more interesting and that has a more complicated operation than an electronic musical instrument that has a conventional IP function.

Further, according to the present invention, since right and left keys in the high and low tone ranges are depressed separately, a person can experience the feeling of using both hands to play and can practice by establishing a balance between the melody and the accompaniment.

The pattern data are divided and are used to prepare measure blocks or tone blocks that are stored in the IP data storage area. The pattern data for the individual blocks are so correlated with each other that they are smoothly and mutually connected with a musical tone that corresponds to another block (so that shifting can not be performed).

The key counter is provided for each tone range to confirm the reading positions for tones of the pattern data. Further, the decision unit is provided so that each pattern data reading position is acknowledged when a measure block of pattern data, which serves as a reference, is to be changed, e.g., when that block is shifted to a succeeding measure block, and that a reading position for succeeding pattern data can be adjusted.

Through this process, when a measure block, etc., is to be changed, positions for reading melody tone data and accompaniment tone data are automatically adjusted. Therefore, no shift or lag is experienced during playing, and a smooth and preferable performance can be provided.

According to the present invention, an instruction means is provided for the selection of pattern data, which are stored in the IP data storage area, and thus by the manipulation of the instruction means, pattern data to which priority for tone production is given can be arbitrarily selected. An electronic keyboard instrument can be provided that is easy to operate and whose functioning is consonant with the purpose of the performance and practice and suits the characteristic of music.

Further, a head reader is provided on the console panel and an interrupt means is incorporated into the CPU. The head reader is operated to play music that begins with an arbitrary measure in the pattern data.

A player can select a favorable measure, or a measure that he desires to practice, and its usability is increased. Practice with particular portions of a musical piece or practice in using several fingers is possible.

In addition, according to the present invention, as a plurality of musical pieces are stored in the IP data storage area and as music select means is provided on the console panel, a desired musical piece can be selected by manipulation of the music select means before the performance starts. Various musical pieces can be arbitrarily selected and played, so that an electronic keyboard instrument has many choices available for the sake of variety.

DETAILED DESCRIPTION OF THE PREFERRED EMBODIMENTS

Figure 1:
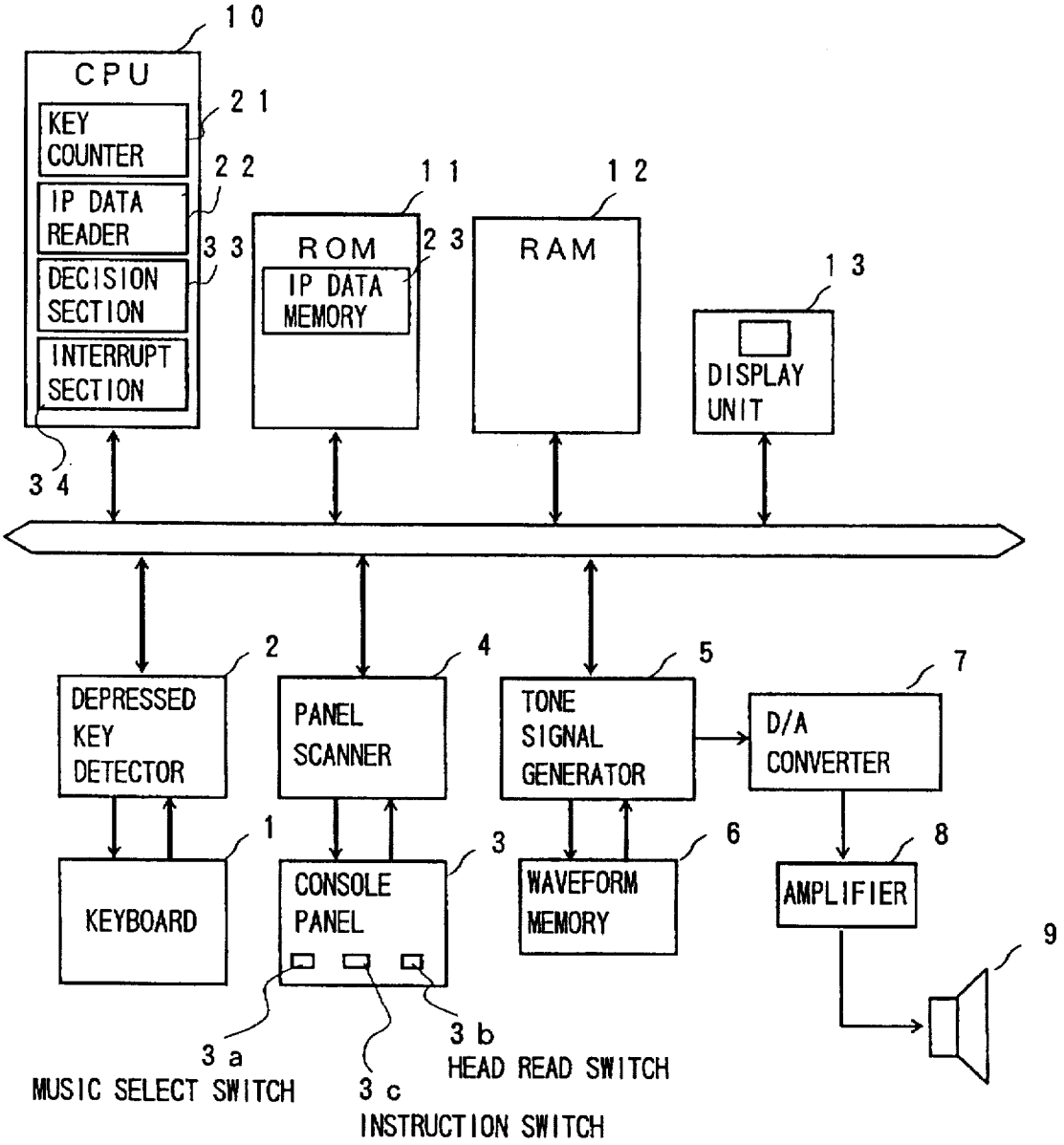
FIG. 1 is a schematic block diagram illustrating the arrangement of an electronic keyboard instrument according to the present invention.

FIG. 1 is a schematic block diagram illustrating the general arrangement of an electronic keyboard instrument according to the present invention. The preferred embodiments will now be described while referring to the accompanying drawings.

An explanation will be given by employing an example wherein accompaniment tones are assigned to a low tone range on a keyboard 1 and melody tones are assigned to a high tone range. In the following drawings, the same reference numbers are used to denote corresponding or identical components.

In FIG. 1, reference number 10 denotes a CPU; 11, a ROM; 12, a RAM; and 13, a display unit. Reference number 1 denote a keyboard; 2, a depressed key detector; 3, a console panel; 4, a panel scanner; 5, a tone signal generator; 6, a waveform memory; 7, a D/A converter; 8, an amplifier; and 9, a loudspeaker.

The CPU 10 controls the individual sections of the electronic keyboard instrument by executing a control program that is stored in a program memory (not shown) in the ROM 11, and reads given IP data in consonance with a key that is depressed at the keyboard 1 and generates tones for that data.

In the CPU 10, therefore, a key counter 21, an IP data reader 22, a decision section 33, an interrupt section 34, etc., are provided as needed.

Stored in the ROM 11, in addition to a program for the operation of the CPU 10, are timbre data and various other fixed data. IP data that are directly related to the present invention are stored in an IP data storage area in the ROM 11; for example, melody data and accompaniment tone data are stored in consonance with the patterns.

In the RAM 12 are defined a work area for the CPU 10, and various registers, counters, flags and buffers, which are employed to control the electronic keyboard instrument. Also, in the RAM 12 is a data area wherein necessary data that are transferred from the ROM 11 are temporarily stored.

Also loaded into the RAM 12 are a plurality of registers wherein data that are required for tone release are set in consonance with the states of keys and switches on the console panel 3, an assigner memory wherein are stored data for assigning tone generation circuits in the tone signal generator 5 to unused channels, and storage areas wherein are stored tone data.

The keyboard 1 is employed to designate a musical tone to be produced and includes a plurality of keys and a plurality of key switches that interact with these keys and are closed and opened when the keys are depressed and released. Key depression and release by a player is detected by the depressed key detector 2, and a detection signal is transmitted to the tone signal generator 5 by the CPU 10.

Play data that are generated by the depression and release of keys on keyboard 1 are temporarily stored in a predetermined area in the RAM 12 and are read by the CPU 10 when necessary.

The depressed key detector 2 detects the depression and release of keys by a player, i.e., the key ON/OFF states, and transmits detected ON/OFF state data to the tone signal generator 5 along with the key number for a depressed key. The CPU 10 stores the key ON/OFF data in the RAM 12.

To provide the IP function effect of the present invention, the depressed key detector 2 identifies the tone ranges for depressed keys, such as a low tone range and a high tone range, or a low tone range, a middle tone range and a high tone range.

The identified key data are temporarily stored in an event buffer in the RAM 12 by the CPU 10 and are read at a predetermined time.

On the console panel 3 are provided a power switch and various other switches, such as a timbre select switch, a mode select switch, a melody select switch and a rhythm select switch, and a display.

A music select switch 3*a*, a head read switch 3*b*, and an instruction switch 3*c*, which are directly related to the present invention, are located on the console panel 3 as needed.

The setting and resetting of these switches on the console panel 3 is detected by the internally provided panel scanner 4. The data for the states of the switches that are detected by the panel scanner 4 are stored in a given area in the RAM 12 by the CPU 10.

In addition to the above described switches, a display section 13 for displaying various data is provided for the console panel 3.

The tone signal generator 5 reads, from the waveform memory 6, tone waveform data and envelope data that correspond to a signal that is output by the CPU 10, adds an envelope to the read tone waveform data and outputs the resultant data as a tone signal.

A tone signal that is output by the tone signal generator 5 is converted into an analog signal by the D/A converter, and the analog signal is then supplied to the amplifier 8. The waveform memory 6 for storing waveform data and envelope data is, therefore, connected to the tone signal generator 5.

The amplifier 8 amplifies, by a given gain, an analog tone signal that is received from the D/A converter 7. The output of the amplifier 8 is transmitted to the loudspeaker 9.

The loudspeaker 9 converts an analog tone signal, which is transmitted as an electric signal by the amplifier 8, into an acoustic signal. That is, a musical tone that corresponds to the generated tone signal is released through the loudspeaker 9.

With this arrangement, when the playing of music begins, depressed key/released key data that are produced at the keyboard 1, which is connected to the depressed key detector 2, and tone generation conditions that are set at the console panel 3, which is connected to the panel scanner 4, are temporarily stored in the RAM 12.

At a predetermined time, keyboard data and panel event data that are stored in the RAM 12 are read by the CPU 10 and calculations with them are performed. The resultant data are transmitted to the tone signal generator 5, where musical tone signals are generated and released as musical tones through the loudspeaker 9.

Figure 2:
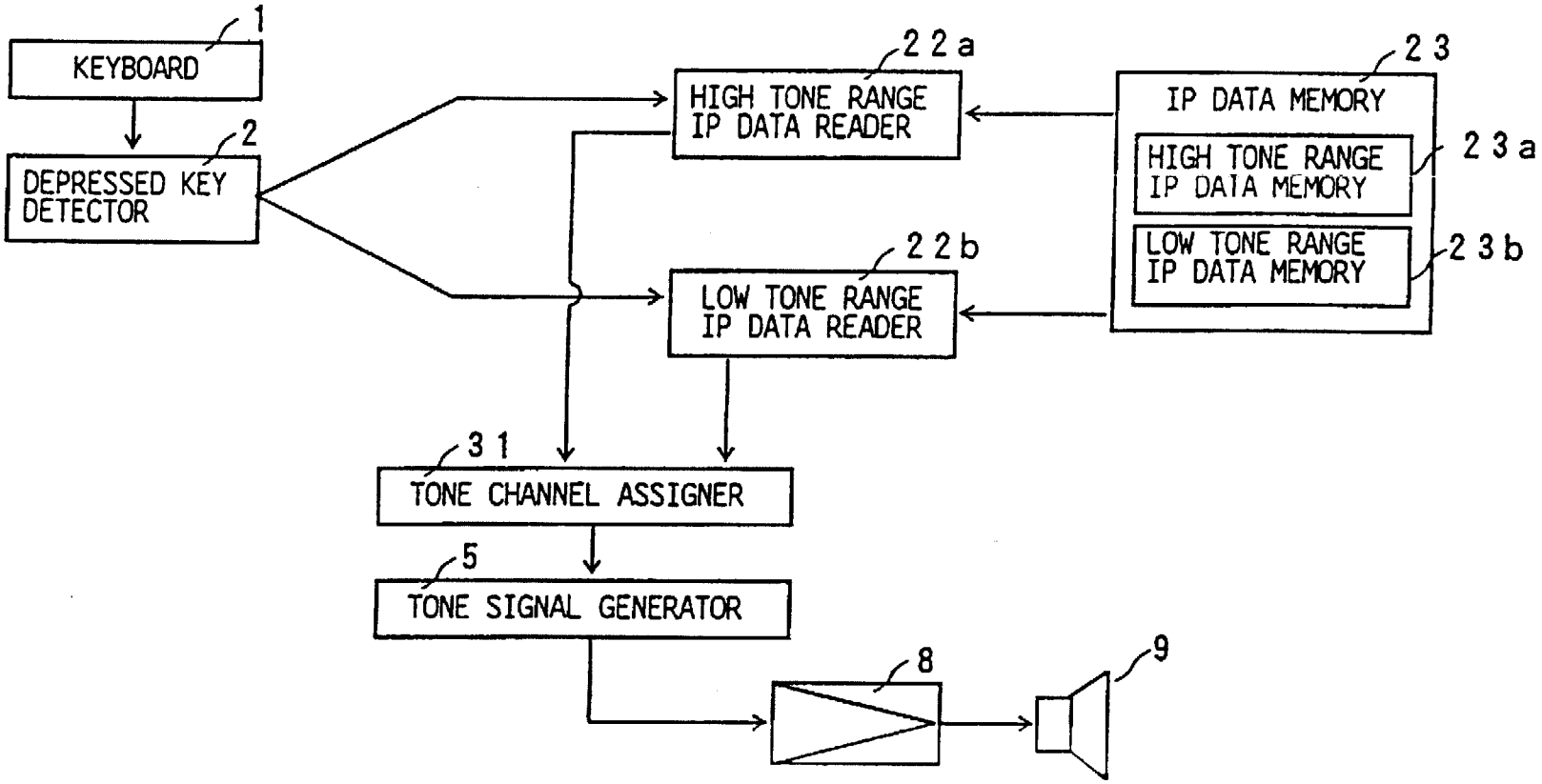
FIG. 2 is a schematic block diagram illustrating an electronic keyboard instrument according to a first embodiment of the present invention.

FIG. 2 is a schematic block diagram for explaining an electronic keyboard instrument according to a first embodiment of the present invention, wherein accompaniment tones are generated one after the other in consonance with the depression of keys in a low tone range on the keyboard, and melody tones are produced one after the other in consonance with the depression of keys in a high tone range. An explanation will not be given for the components that have been described while referring to FIG. 1.

In this embodiment, the IP data reader 22 in FIG. 1 is constituted by an IP data reader 22*a* for a high tone range and an IP data reader 22*b* for a low tone range. The IP data storage area 23 consists of an IP data storage area 23*a*, for a high tone range, wherein melody tone data are stored as high tone range IP data, and an IP data storage area 23*b*, for a low tone range, wherein accompaniment tone data are stored as low tone range IP data.

The high tone range IP data reader 22*a* reads high tone range IP data, i.e., the melody tone data, from the high tone range IP data storage area 23*a* in the IP data storage area 23. When the CPU 10 verifies that a signal that is obtained from the event buffer is an event in a high tone range, the CPU 10 transmits that signal to the high tone range IP data reader 22*a*.

Upon the receipt of this signal, the high tone range IP data reader 22*a* reads, from the high tone range IP data storage area 23*a*, the melody tone data for a single tone in the high tone range.

When the low tone range IP data reader 22*b* receives a signal that the CPU 10 reads from the event buffer, the IP data reader 22*b* reads the low tone range IP data, i.e., the accompaniment tone data, from the low tone range IP data storage area 23*b*.

In consonance with the manipulation of the depressed key detector 2, the tone-ON channel assigner 31 assigns, to a predetermined tone-ON channel, an internal tone source that is transmitted by the IP data reader 22*a* or 22*b*. The tone data from the tone-ON assigner 31 are transmitted to the tone signal generator 5.

With such an arrangement, upon the depression of a key in the high tone range, a single melody tone is produced, while upon the depression of a key in the low tone range, a single accompaniment tone is generated. Therefore, in response to the manipulation of the keyboard using both hands, tones that correspond to keys in the high tone range and in the low tone range on the keyboard are generated, so that an operator has the sensation of actually playing music.

Figure 3:
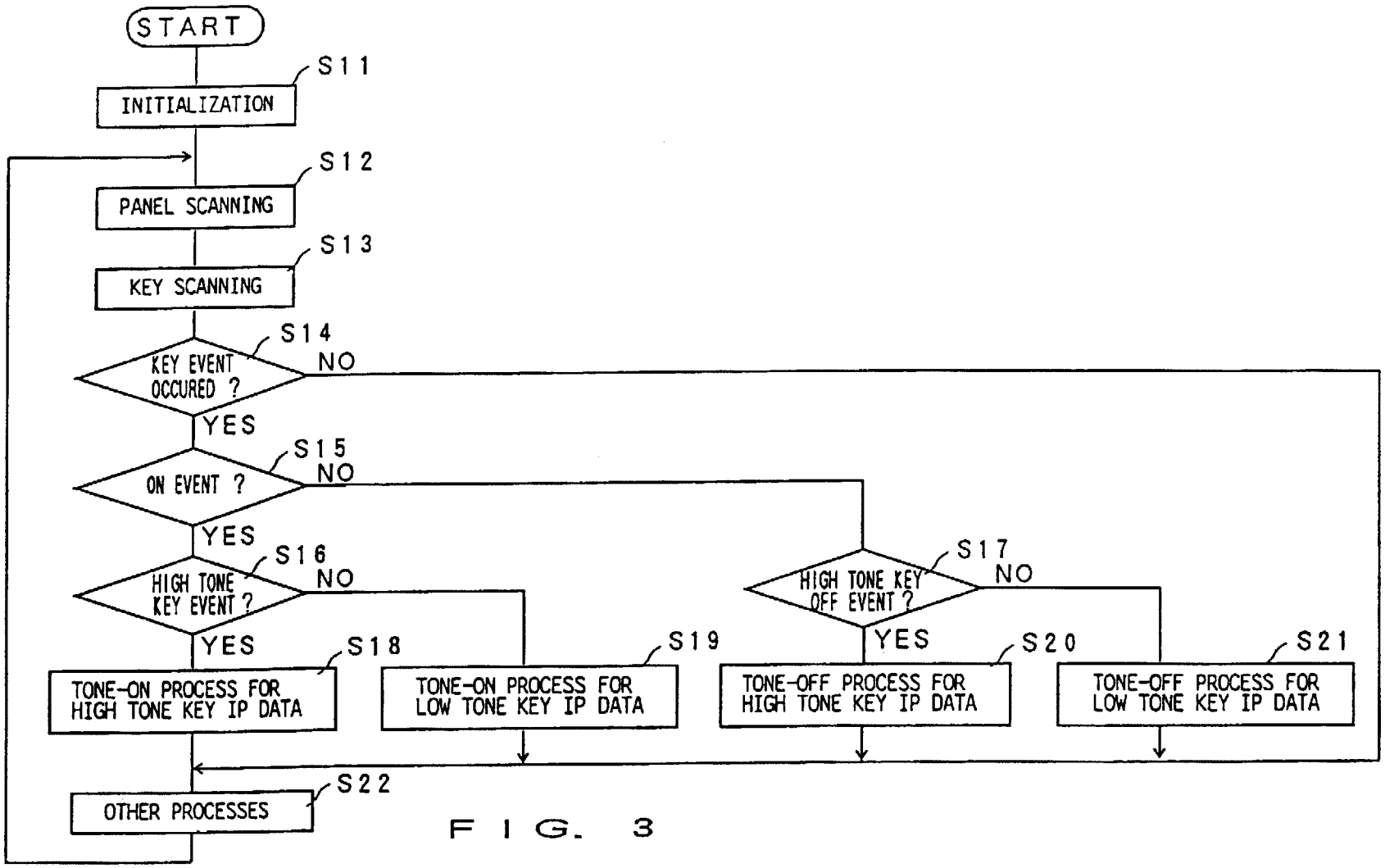
FIG. 3 is a flowchart for explaining the processing for the electronic keyboard instrument according to the first embodiment of the present invention.

FIG. 3 is a flowchart for explaining the processing of the first embodiment. When a power switch, which is provided on the console panel 3, or a reset switch is depressed, the initialization is performed (step S11).

In this process, data in the internal register of the CPU 10 and in the RAM 12 are cleared, initial values are set in them, predetermined data or program data that are stored in the ROM 11 are moved to the RAM 12, a timbre pointer is initialized to determine an initial timbre, and the LSI of the tone signal generator 5 and various I/O ports are initialized.

Then, panel scanning is performed (step S12). In this process, data that are detected across the console panel 3 by the panel scanner 4 are employed to determine whether or not a panel event has occurred. According to the result of the decision, ON/OFF state data for the switches are prepared and are stored in the RAM 12.

The switch ON/OFF states that are currently fetched across the console panel 3 are compared with the switch ON/OFF states (which are already stored in another area in the RAM 12) that were previously fetched across the console panel 3. An event map, in which are set only those bits that correspond to the switches that are newly in the ON state, is created.

Following this, key scanning is performed (step S13). In this process, data are collected that concern the key depression state at the keyboard 1 and that are detected by the depressed key detector 2, and are set to a new key buffer. The contents of an old key buffer and of the new key buffer are compared with each other, and a key event buffer is created in which the portions correspond to the manipulated keys that are set ON or OFF.

The detection of a tone range for a depressed key, which is directly related to this embodiment, is performed in the key scanning process, and the result is stored in a specific area in the RAM 12 by the CPU 10.

Then, a check is performed to determine whether or not a key event has occurred (step S14). In this process, a fetched event buffer is searched to determine whether or not a key event has occurred, i.e., whether a key has been depressed or released, and tone generation is performed or tone generation is halted in consonance with the key event.

When, at step 14, no key event has occurred, neither the tone generation nor the halting of tone generation is necessary, and program control moves to step S22 for "other processes."

If, at step 14, a key event has occurred, a check is performed to determine whether or not the key event is an ON event (step S15).

If, as the result of the determination, the event is an ON event, it is necessary to examine whether or not tone generation for any part is required. A check is then performed to determine whether or not the ON event is an ON event for a part in the high tone range (step S16). This process is performed by the CPU 10, which examines a key event buffer in a predetermined area of the RAM 12.

When, at step S16, the event is an event for the high tone range, the CPU 10 permits the high tone range IP data reader 22*a* to read one piece of data from the high tone range IP data storage area 23*a*, and a melody tone is generated (step S18).

In this tone generation process, in consonance with the control data that are received from the CPU 10, the tone signal generator 5 reads tone wave data that correspond to a selected timbre from the waveform memory 6, adds an envelope to it, and outputs the resultant data as a digital tone signal.

Sequentially, the other processes are performed (step S22). The "other processes" are a switch event process, a keyboard event process, a pedal process, a sequencer process, etc., which correspond to detected events. For example, switch events for timber selection, rhythm selection, volume change, and timbre change are handled here.

When the "other processes" are completed, program control returns to step S12, and the panel scanning is performed for the production of a succeeding musical tone.

If, at step S16, the event is not a high tone range key event, that event is assumed to be a low tone range key event, and the tone generation for low tone range IP data is performed (step S19). More specifically, the CPU 10 permits the IP data reader 22*b* to read a piece of data from the low tone range IP data storage area 23*b*.

Then, data for a single accompaniment tone is read and the tone is generated. Program control moves to step S22 and the above described "other processes" (step S22) are performed.

When, at step S15, the event is not an ON event, i.e., when it is not necessary for tone generation to be performed, a check is performed to determine whether or not the event is a key-OFF event for the high tone range (step S17). When the event is a key-OFF event for the high tone range, a tone-OFF process is performed for the high tone range IP data (step S20).

In this tone-off process, the CPU 10 transmits the control data for the high tone range to the tone signal generator 5 to halt the production of the melody tones that are being released. Then, program control goes to step S22 and the above described "other processes" (step S22) are performed.

When, at step S17, the event is not a key-OFF event for the high tone range, the event is assumed to be a low tone range key-OFF event, and the tone-OFF process is performed for low tone range IP data (step S21).

More specifically, the CPU 10 transmits the control data for the low tone range to the tone signal generator 5 to halt the production of the accompaniment tones that are being released. Program control thereafter goes to step S22, and the above described "other process" (step S22) are performed.

According to this embodiment, upon the depression of keyboard keys in the high tone range, melody tones are read and produced in order, and upon the depression of keyboard keys in the low tone range, accompaniment tones are read and produced one after the other. A player, therefore, can experience the sensation of actually playing the instrument.

Figure 4:
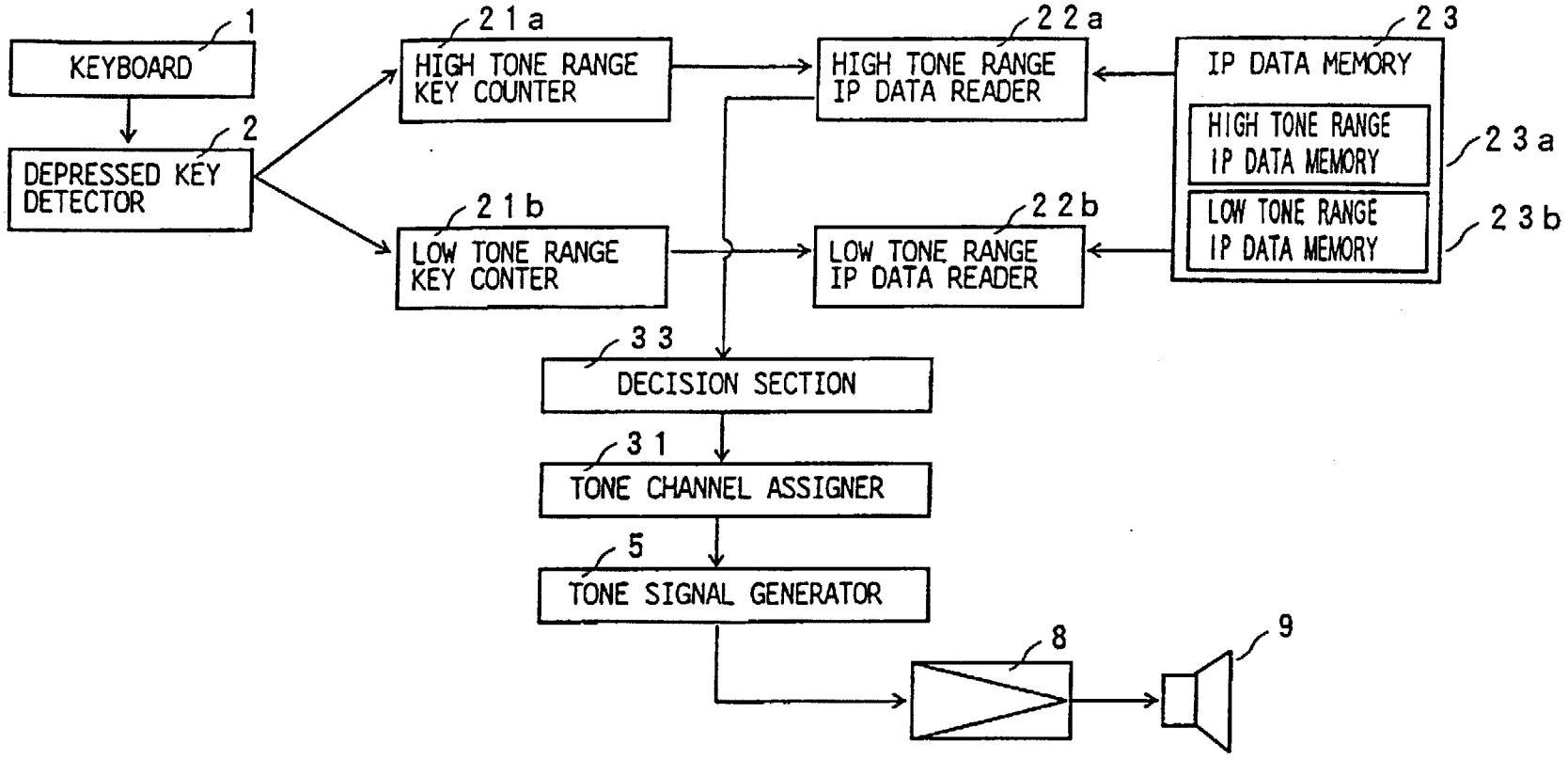
FIG. 4 is a schematic block diagram illustrating an electronic keyboard instrument according to a second embodiment of the present invention.

FIG. 4 is a schematic block diagram for explaining an electronic keyboard instrument according to a second embodiment of the present invention. In addition to the arrangement in the first embodiment, in the second embodiment a function is added whereby a position at which accompanying data, such as data for accompaniment tones in the low tone range, are to be read is adjusted when reference pattern data stored in the IP data storage area 23, such as pattern data for melody tones in the high tone range, are positioned at the point where a measure block or a tone block is changed, i.e., at the point where a shift is made to a succeeding measure or a succeeding tone.

More specifically, in the second embodiment, when a player employs melody tones as references for generation, an accompaniment tone that is to be successively generated is corrected in such a manner as to provide an accompaniment tone (an accompaniment tone that is not shifted) that is consonant with a melody tone that is currently being produced, so that the two tones are matched.

In this embodiment as well as in the first embodiment, an explanation will be given for an example where melody tones are assigned to a high tone range that serves as a reference tone range.

Melody tone data and accompaniment tone data are stored in a high tone range IP data storage area **23*a* and a low tone range IP data storage area 23*b*** as measure blocks or as tone blocks with, for example, an END mark inserted therein.

A memory block has a one-to-one correspondence with the pattern data for each tone range, and musical tones that are to be generated at the same time are arranged at the heads of the pattern data that have an identical block number.

A high tone range key counter **21*a* and a low tone range key counter 21*b* are provided for each tone range. The positions of depressed keys are detected by a depressed key detector 2, with the detection results being counted by the tone range key counters 21*a* and 21*b*, and the results being sent to the IP data readers 22*a* and 22*b***.

In this manner, pattern data reading positions can be acquired with, for example, tone numbers by the high tone range key counter **21*a* and the low tone range key counter 21*b***.

In addition, a decision section 33 is provided. The decision section 33 examines the progression of music, while it refers to the high tone range key counter **21*a*** that is a reference, and determines the time at which a reading position for succeeding high tone range melody data is to be shifted to a new measure.

Following this, the low tone range key counter **21*b* is examined to determine whether or not a position for data that are to be read next by the low tone range IP data reader 22*b*** is located at the head of the next, new block. When the reading position for accompaniment data is shifted, the reading position for the next data is adjusted and is set for the head of an appropriate block.

To provide such a correction, a measure number and a serial number, for example, are added to data, of pattern data, that are stored as blocks, thus enabling the data to be identified and managed.

A serial number is given beginning with the first musical tone and is employed to determine a boundary of the blocks. Or with another control method that uses a block number and with which a serial number is given for each block, a block number is employed as a reference, a serial number is provided beginning with the first block and a value that is held by the counter is cleared each time the memory block is changed so that counting starts at 0.

With this method, accompaniment tone data that are located at a correct position, i.e., accompaniment tones that correspond to melody tones, are always read at the point whereat the melody data are changed. The melody tones and the accompaniment tones are not shifted greatly during playing, and even a beginner can enjoy playing without worrying about what he touches with both hands.

The processing in the second embodiment will now be described while referring to FIG. 5. The procedures listed in this flowchart, aside from those at step S38 and S39, are the same as in the first embodiment in FIG. 3, and no explanation for them will be given here.

When a key event that is detected at step S36 is a high tone range key event, since the tone range where the event has occurred serves as a reference tone range, a check is performed to determine whether or not succeeding melody tone data are to be read from a measure block that is different from that for the melody data that are currently being processed (step S38).

In this process, a block number, for example, is examined to determine whether or not there is a change in a memory block that includes a tone with a tone number, which is stored in the high tone range key counter **21*a***, and in a memory block that includes a succeeding tone.

When the memory block is identical, there is no change in the measure to which data to be read belong, and the correction process is not required. Program control therefore skips step S39 and goes to step S40, where tone generation is performed for high tone range key IP data (step S40).

Figure 6:
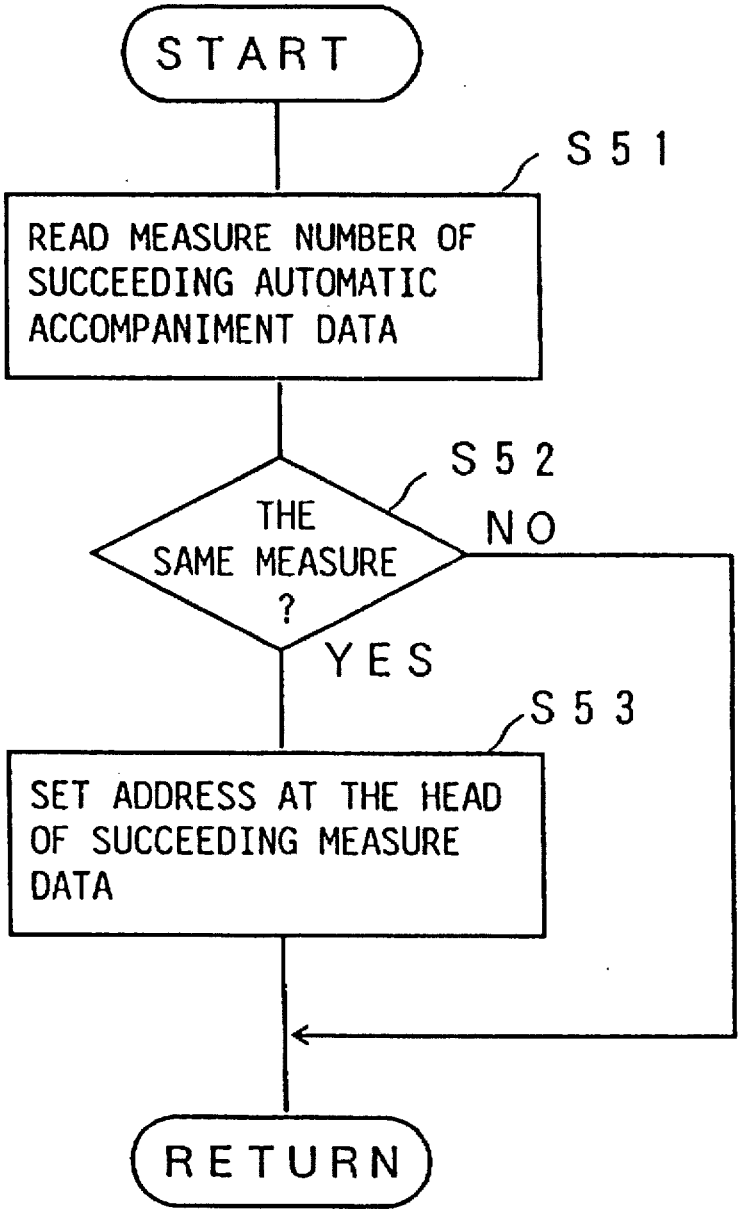
FIG. 6 is a flowchart for explaining the processing for correcting a data reading position.

If, at step S38, a measure is changed for the position for reading data in a reference tone range, the number of a block to which succeeding data that are to be read belongs is stored in a predetermined area in the RAM 12, and the correction process, which will be described later in FIG. 6, is performed (step S39).

The correction process will be described in detail while referring to FIG. 6.

Figure 5:
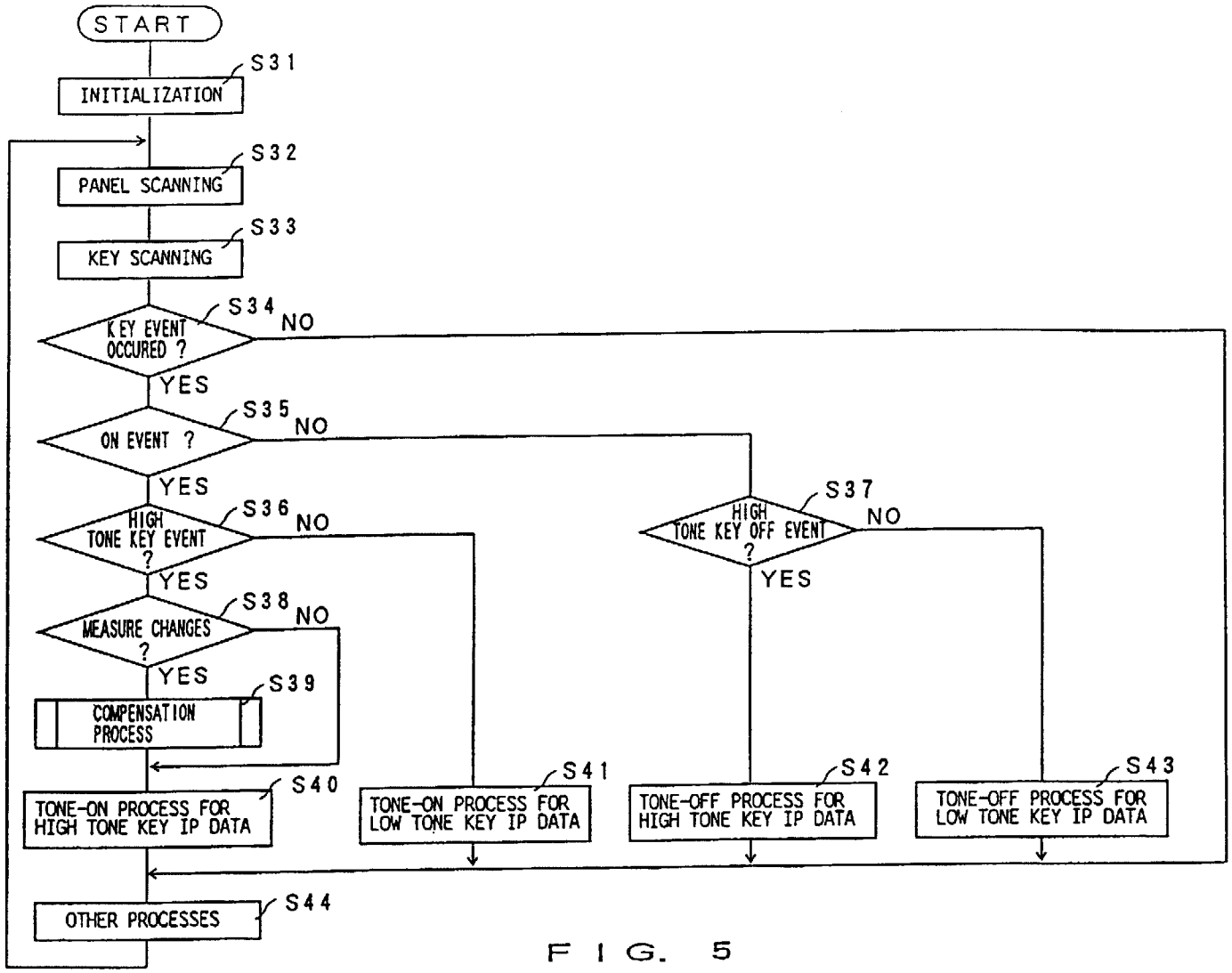
FIG. 5 is a flowchart for explaining the processing for the electronic keyboard instrument according to the second embodiment of the present invention.

When, at step S38 in FIG. 5, there is a change in the number of a block from which succeeding data for a reference tone range are to be read, it is assumed that there is a change in a measure to be read, and the correction process is performed sequentially (step S39).

In the correction process, first, a measure (block) is read, which includes succeeding data in the other tone range that are to be read, i.e., succeeding accompaniment data in the low tone range that are to be read. The read-out measure (block) is stored in the predetermined area in the RAM 12 (step S51).

A check is performed to determine whether or not there is a change in a measure between current data and succeeding data that are to be read (step S52). In this process, a memory block, which includes a tone that was previously read and whose tone number is stored in the low tone range key counter 21b, is compared with a memory block to which those succeeding data belong that were read and were stored at step S51.

If the memory block for previously read data and the memory block for data that are to be read are different, it is assumed that the accompaniment tones are generated at a correct timing. Program control skips step S53 and returns to the main routine.

If, as the decision at step S52, it is determined that the memory block for the previously read data is the same as the memory block for the data that are to be currently read, the timing for the production of accompaniment tones is shifted. The decision section 33 sets the position, for the accompaniment tone data that are to be successively read, at the head position of the memory block with the same block number, for the data that are read next, to access to the data, in the reference tone range, that are stored in a predetermined area in the RAM 12 (step S53). Program control thereafter returns to the main routine.

Through this process, when the reading position for data in a reference tone range is set at the time of a change of a measure, the reading position for data in the other tone range is also set. When a key in the low tone range is depressed, tone production is performed for an accompaniment tone at the head of the same measure as for data in a reference tone range, i.e., in the high tone range.

As is described above, according to the present invention, each time the measure for a tone that is to be generated in the reference tone range is changed, the reading position for a tone in the other tone range that is to be generated is adjusted. Substantial shifting does not occur, and smooth and preferable playing can be enjoyed.

Figure 7:
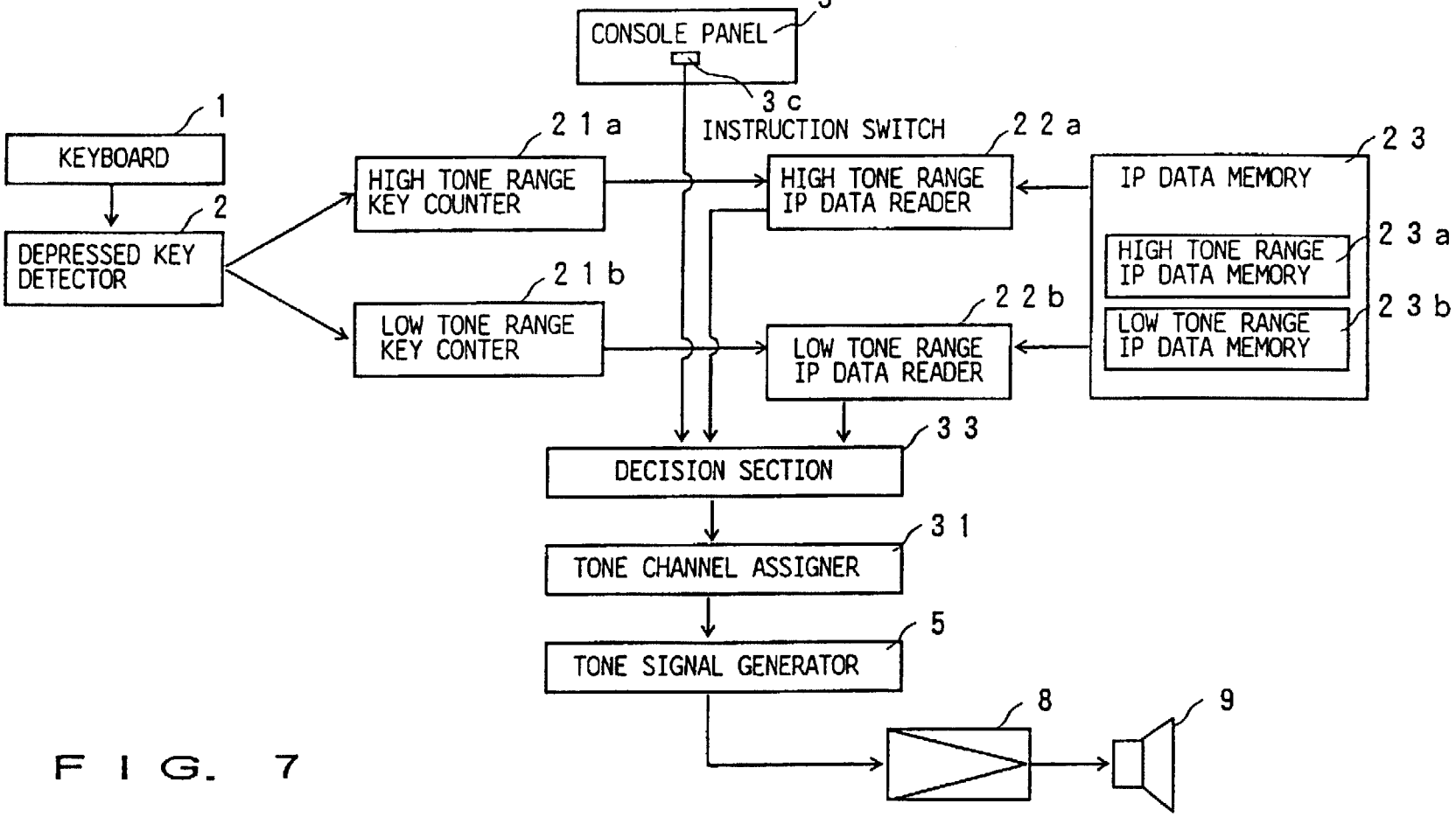
FIG. 7 is a schematic block diagram illustrating an electronic keyboard instrument according to a third embodiment of the present invention.

A third embodiment wherein a reference tone range that is employed in the second embodiment can be switched will now be described while referring to FIG. 7.

In addition to the arrangement in the second embodiment, in the third embodiment, an instruction switch 3c for instructing the switching tone ranges for a reference is provided on a console panel 3. By manipulation of the instruction switch 3c, the priority order for a tone range that serves as a reference for music progression can be changed.

The instruction switch 3c is, therefore, a rotary switch, for example. The set condition of the switch 3c is scanned by the panel scanner 4 and the scanning result is stored in a predetermined area of the RAM 12 by the CPU 10.

When an ON event occurs in a tone range that is set as a reference tone range, a check is performed to determine whether or not a block to which data belong that are to be read next by a decision section 33 is to be changed, i.e., a succeeding measure is to be changed. When a succeeding measure is to be changed, the next reading position in the other tone range is examined. If there is a shift in position, adjustment is performed as needed. This process is the same as in the second embodiment.

When a player depresses a key in the high tone range or in the low tone range, the pattern data for which the reading position is adjusted are read from the IP data storage area 23, and a tone for which the reading position is adjusted is generated at a timing at which the player touches a key.

Therefore, in consonance with the characteristic of a musical piece, a player's taste, and the object of practice, a player can freely set a priority tone range that serves as a reference. An electronic keyboard instrument that is more usable can be provided.

This embodiment is different from the first and the second embodiments in that a tone range that is employed as a reference can be changed by the manipulation of the instruction switch 3c. The operation during playing is the same as that in the second embodiment.

Figure 8:
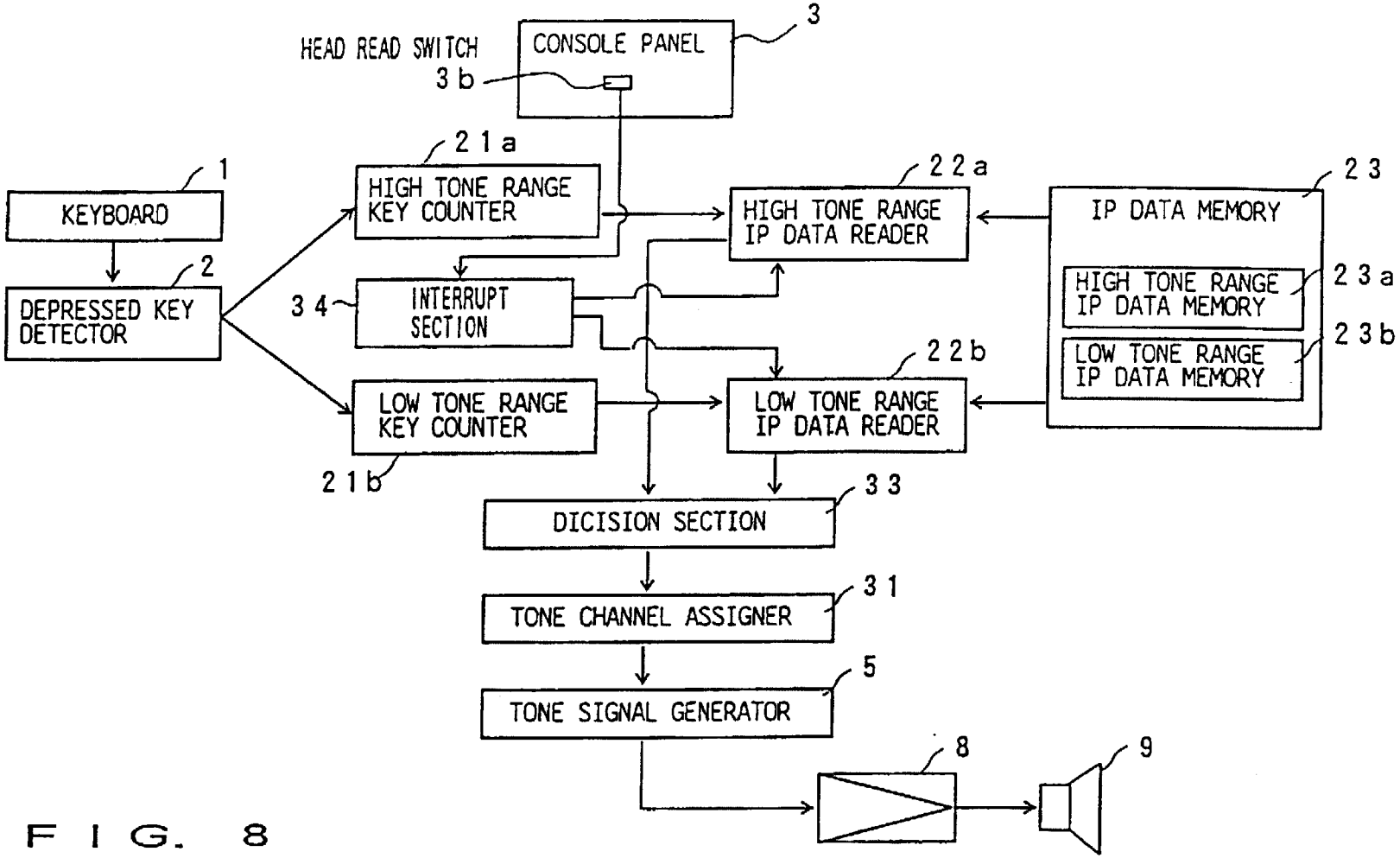
FIG. 8 is a schematic block diagram illustrating an electronic keyboard instrument according to a fourth embodiment of the present invention.

A fourth embodiment wherein a start position for tone production in the second and the third embodiments can be set to an arbitrary block will now be described while referring to FIG. 8.

This embodiment is applied to an electronic key instrument wherein pattern data for each tone range are stored as blocks.

A head read switch 3b for designating a desired block from which playing is begun is provided on a console panel 3. The number of a measure block or a tone block is designated by using the head read switch 3b. A decision section 33 then sets start positions at which IP data readers 22a and 22b read pattern data at the heads of predetermined measure blocks or tone blocks.

The head read switch 3b is, for example, a rotary switch, and is manipulated to set an arbitrary measure or tone. Or, there is another method that involves the use of an editor and a display that serve as the head read switch 3b to set an arbitrary measure or a tone.

When pattern data in a reference tone range is designated and when a measure at the tone generation start position is selected by the head read switch 3b, the decision section 33 first specifies the tone production start position for pattern data in the reference tone range, and sets the position at the IP data reader 22 for that tone range, e.g., the high tone range IP data reader 22a.

Then, using the same procedures as in the correction process in the second embodiment, reading start positions for the individual tone ranges are set at the IP data reader 22a and 22b, respectively, and the key counts held by the counters 21a and 21b are set to numbers that are immediately before the data that are set by the readers 22a and 22b.

In this manner, a player can start playing at an arbitrary measure block or an arbitrary tone block, and the usability of an electronic keyboard instrument according to the present invention is increased.

Figure 9:
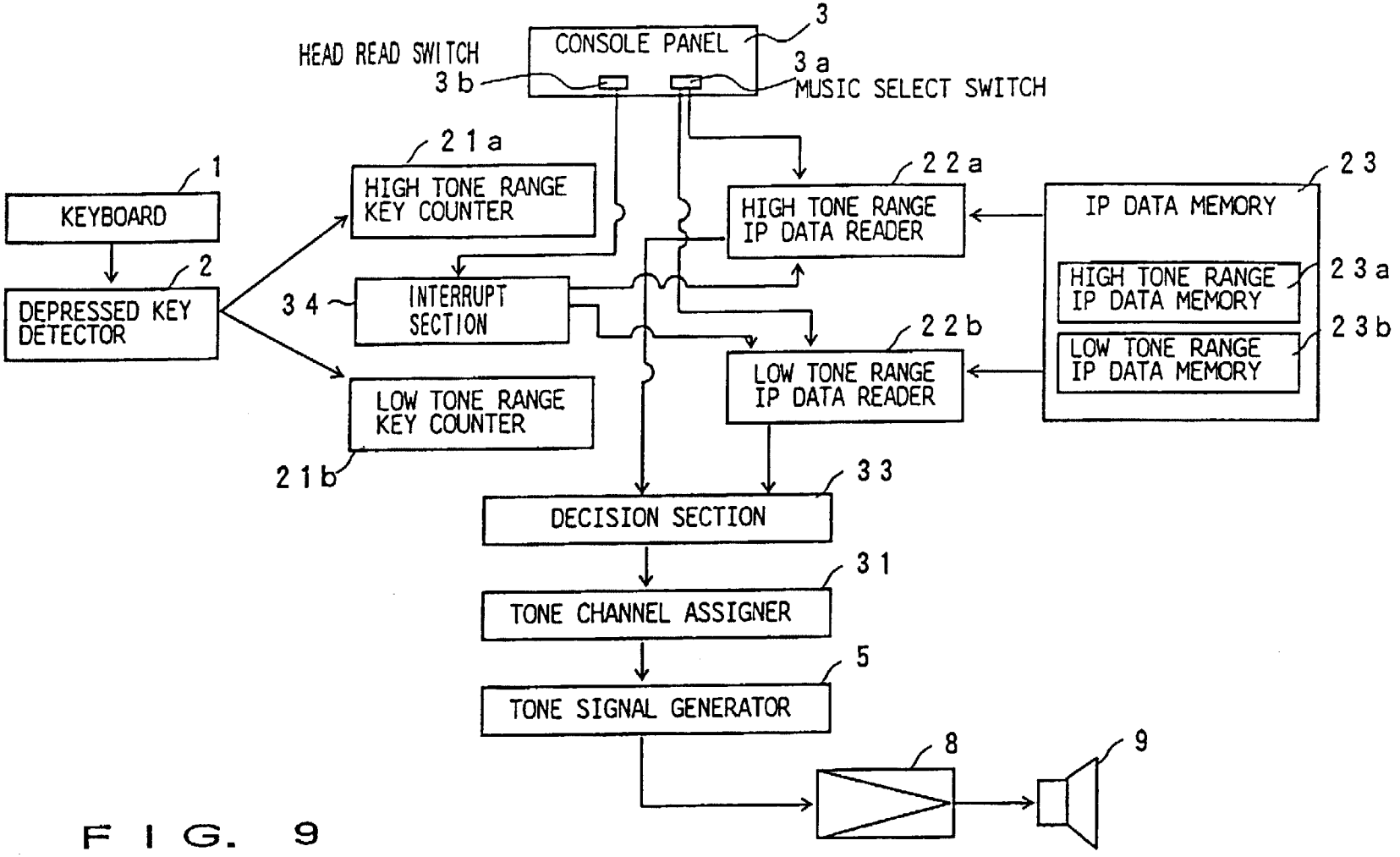
FIG. 9 is a schematic block diagram illustrating an electronic keyboard instrument according to a fifth embodiment of the present invention.
Figure 10:
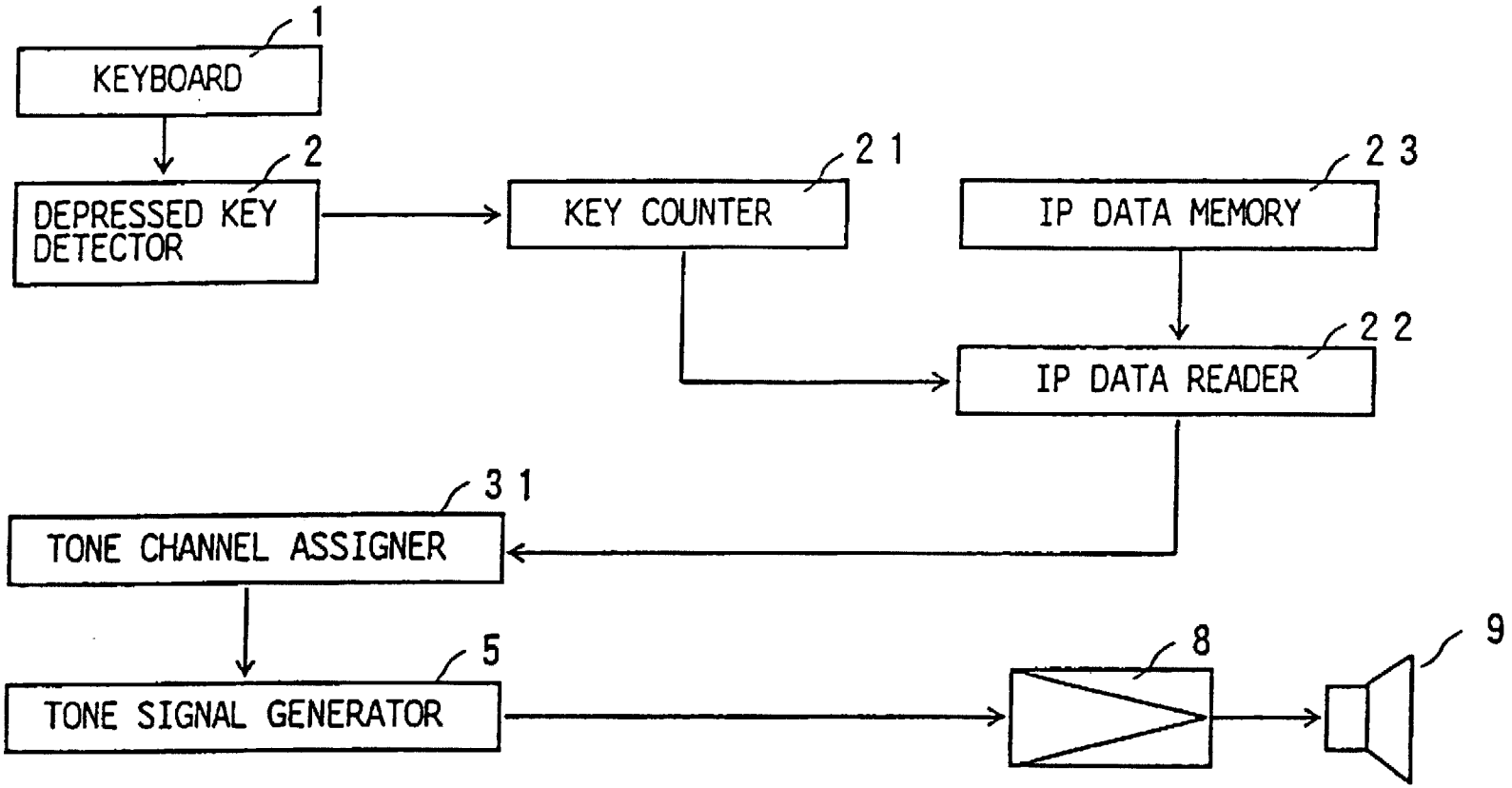
FIG. 10 is a schematic block diagram for explaining the arrangement of a conventional tone generator.
Figure 11:
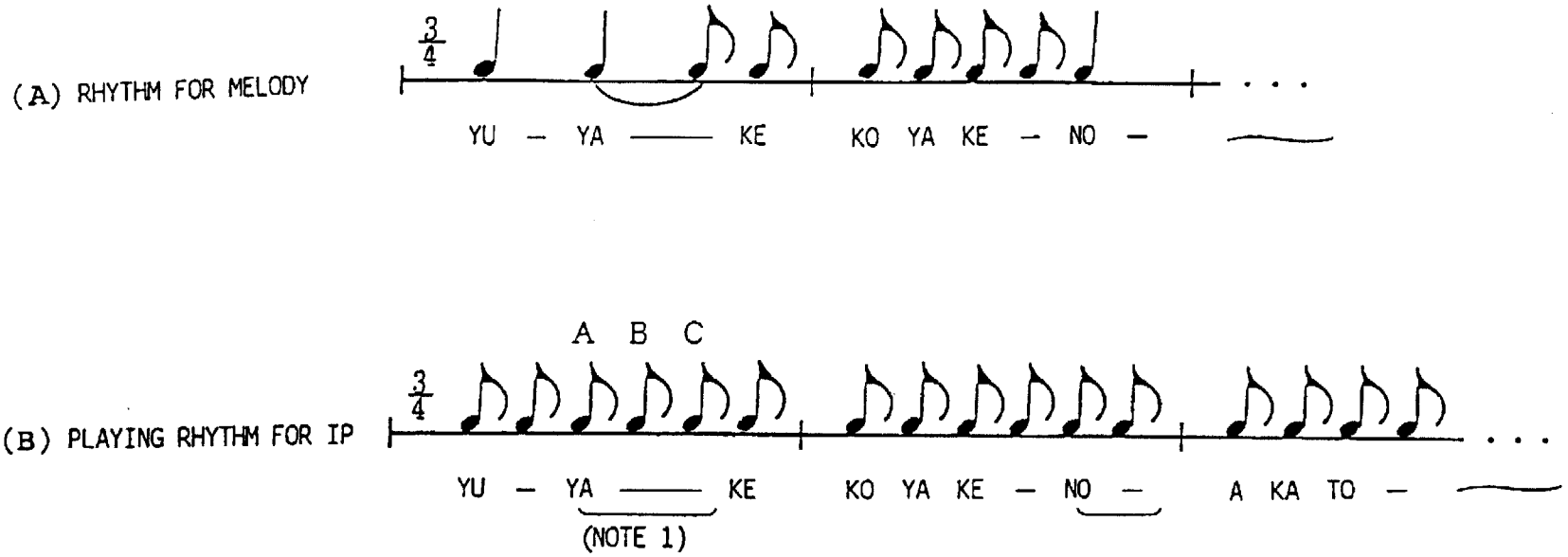
FIG. 11 is a diagram for explaining the relationship between a rhythm and musical notes by employing a Japanese juvenile song, "Aka-tombo (red dragonfly)."

A fifth embodiment, wherein in addition to the functions in the first through the fourth embodiments an arbitrary musical piece can be selected from among a plurality of musical pieces, will now be described while referring to FIG. 9. An instruction switch 3c is omitted in FIG. 9.

Pattern data for melody tones and for accompaniment tones of a plurality of musical pieces are stored, as tone ranges or as blocks for tone ranges, in an IP data storage section 23 in the fifth embodiment.

A musical select switch 3a is provided on a console panel 3 to select a desired musical piece. The musical select switch 3a is manipulated to designate, for example, a musical number.

An interrupt section 34 is provided in the CPU 10. In consonance with the setting of the musical select switch 3a, the interrupt section 34 specifies an address of a music reading start position for each tone range by referring to a table, and transmits it to a decision section 33.

In response to this, the decision section 33 sets data that correspond to IP data readers 22a and 22b and key counters 21a and 21b. Through this process, tones of a desired musical piece are generated.

As is described above, according to these embodiments, a usable electronic keyboard instrument can be provided wherein an arbitrary musical piece can be chosen from among a plurality of musical pieces, a tone range that is employed as a reference can be changed, and a timing for tone generation in another tone range can be automatically adjusted.

If setting conditions, such that accompaniment tones are not generated unless two or three keys are alternately depressed, is added to the present invention, an electronic keyboard instrument can be provided that affords greater variety and that is more interesting, and that can be employed for finger practice.

As is described above, according to the present invention, a person who is not skilled in playing musical instruments can generate melody tones and accompaniment tones by simple manipulatory movements with both hands while disregarding the pitches, and both a desire to play a keyboard instrument can be gratified, and a complaint that the manipulations that are required for playing music are too simple can be removed.

According to the present invention, since the correlation between melody tones and accompaniment tones are appropriately adjusted, the melody tones and the accompaniment tones will not greatly shift relative to each other, and smooth and preferable playing can be provided.

Various modes of carrying out the invention are contemplated as being within the scope of the following claims that specifically point out and distinctly describe the subject matter that is regarded as the invention.

What is claimed is:

1. An electronic keyboard instrument, comprising:

a plurality of data storage means for defining pattern data that correspond to a plurality of tone ranges into which a tone range on a keyboard is divided, and for storing said pattern data that are defined independently wherein said pattern data are divided into sets for every measure block or for every tone block, and are correlated for each other when stored in said data storage means; and a plurality of data reading means for reading corresponding pattern data from said data storage means, wherein, when keys that belong to said tone ranges are depressed, said pattern data that correspond to said tone ranges are read one at a time from whichever of said data storage means is pertinent.

2. An electronic keyboard instrument according to claim 1, further comprising:

key count means for counting said pattern data, which are read from said data storage means, for each measure block or for each tone block of said pattern data for each of said tone ranges; and a decision means for detecting a change of said measure block or of said tone block when said measure block or said tone block at a reference pattern data read position is to be changed, for finding a reading position for succeeding data or another pattern data, and for adjusting said position when said reference pattern data reading position and said reading position for said succeeding data are shifted.

3. An electronic keyboard instrument according to claim 2, further comprising an instruction means for instructing the reading of said reference pattern data.

4. An electronic keyboard instrument according to claim 2, further comprising a head read means for selecting and reading an arbitrary measure block or a tone block from each of said pattern data sets that are stored in said data storage means, wherein said decision means permits reading a predetermined measure block or tone block in consonance with a set value that is selected by said head read means.

5. An electronic keyboard instrument according to claim 1, wherein said pattern data for a plurality of musical pieces are stored in said data storage means, wherein a desired musical piece is selected by music select means, and wherein interrupt means determines a tone generation start position for pattern data for said desired musical piece.

6. An electronic keyboard instrument according to claim 1, wherein said tone range of said keyboard is divided into a high tone range and a low tone range.

7. An electronic keyboard instrument according to claim 1, wherein said pattern data are melody tone data and accompaniment tone data.

* * * * *